United States Patent [19]

Tysinger

[11] Patent Number: 4,583,474

[45] Date of Patent: Apr. 22, 1986

[54] AUXILLARY CONTROL APPARATUS FOR SEWING MACHINES

[76] Inventor: Charles A. Tysinger, Rte. 9, Box 567, Asheboro, N.C. 27330

[21] Appl. No.: 719,213

[22] Filed: Apr. 2, 1985

[51] Int. Cl.[4] ..... D05B 69/06

[52] U.S. Cl. ..... 112/217.3; 112/277; 74/515 E; 74/512

[58] Field of Search ..... 112/217.3, 217.4, 270, 112/277; 74/491, 515 E, 504, 512, 515 R, 562

[56] References Cited

U.S. PATENT DOCUMENTS

| | | | |
|---|---|---|---|
| 1,772,361 | 8/1930 | Mross et al. | 74/512 |
| 1,911,223 | 5/1933 | Daleo | 74/512 |
| 2,055,432 | 9/1936 | Goosman et al. | 112/217.3 |
| 2,065,428 | 12/1936 | Chason | 112/217.3 |
| 2,952,164 | 9/1960 | Hofgesang | 112/217.4 |
| 3,479,901 | 11/1969 | Lee | 112/217.3 |
| 4,284,018 | 8/1981 | Szostak | 112/217.4 |

*Primary Examiner*—Werner H. Schroeder
*Assistant Examiner*—Andrew M. Falik
*Attorney, Agent, or Firm*—Charles R. Rhodes; Judith E. Garmon

[57] ABSTRACT

A motor control mechanism for adapting electric sewing machines to be used by handicapped people, is mounted on the sewing machine or adjacent thereto and includes a motor control means operatively connected between the machine motor and a variable control arm which is activated by the operator's arm, or head, or knee.

3 Claims, 2 Drawing Figures

AUXILLARY CONTROL APPARATUS FOR SEWING MACHINES

BACKGROUND AND SUMMARY OF PRESENT INVENTION

A variety of approaches have been made to modifying conventional electric sewing machines for use by handicapped persons or other individuals who do not desire to or cannot operate the machine by the standard foot or knee activated motor control.

Two U.S. Pat. Nos. 3,479,901 and 4,284,018, recognize the desirability of providing other means for operating the electric motor. U.S. Pat. No. 3,479,901 discloses an arm control mechanism particularly adapted for commercially sized machines used by handicapped persons. As seen in FIG. 2, the device is comprised of a multiplicity of unwieldly interconnected levers which are substantially permanently attached to the sewing machine. U.S. Pat. No. 4,284,018 discloses a hand operated device which is comprised of the standard machine foot control and a plurality of speedsetting keys mounted in a housing on top of the machine cabinet.

Problems with these devices include difficulties in installation (particularly for short periods of temporary use); complexity of parts and thereby expensive production; and lack of the capability of being activated by arm, hand, head or knee. It is therefore a primary object of the present invention to provide a means and apparatus for controlling electric sewing machines, which apparatus can be selectively attached to a sewing machine and render it operable by handicapped persons who have use of their hands or arms.

SUMMARY OF THE PRESENT INVENTION

The present invention is a sewing machine motor control apparatus which comprises a minimal number of simple components, the combination of which is adaptable to a variety of installations. In a preferred embodiment of the present device the housing and controls are arranged for use on machines having cabinets, or on those portables which are set on tables. The operator activates the control by using the forearm or elbow. The principal components of the control apparatus include a housing which encloses a variable resistor that is operatively connected to the electric motor on the machine. An operator control arm is hingedly connected to the exterior of the housing and a plunger mechanism extends between the variable resistor and the control arm. Depression of the control arm by the operator moves the plunger into contact with the variable resistor, which in turn activates and controls the speed of the machine motor according to the degree of depression.

The housing itself is constructed of top, bottom and side walls which completely enclose the variable resistor. The plunger is an elongated rod extending through one wall of the housing such that an exposed end is positioned directly behind the operator control arm or plate which is hingedly connected to the housing. The control arm is a flat, elongated, plate-type member which has one end hingedly connected to the exterior surface of one of the housing walls. Depression of the control arm or plate pushes the plunger inwardly into contact with the variable resistor.

Although this preferred embodiment is disclosed for mounting on the top surface of the machine cabinet or on a table adjacent the machine head, with minor modifications it could be mounted on top of the machine or immediately behind and above the machine for use by depressing the control plate with the head of the operator. Additionally, for machines having only a foot pedal, the housing could be mounted on a lower surface of the cabinet for activation by the knee by those persons who have little or no flexing movement of the the feet.

The present auxillary control is a substantially portable device that can be selectively connected to sewing machines of a wide variety of types. The housing attaches to the cabinet or table by means of simple clamping devices. The sewing machine is plugged directly into the control, which is in turn plugged into an electric power source. When the sewing operation is completed, the auxillary control is disconnected and removed. The sewing machine is then ready for conventional operation.

The foregoing and other modifications will be obvious to those skilled in the art upon studying the following detailed description in conjunction with the following drawings. In the drawings:

FIG. 1 is a perspective view of a preferred embodiment of the present invention as mounted on a conventional electric sewing machine; and FIG. 2 is a perspective view of the inner housing, illustrating the operative relationship of the components.

DETAILED DESCRIPTION OF PREFERRED EMBOIDMENT

Figure 1:
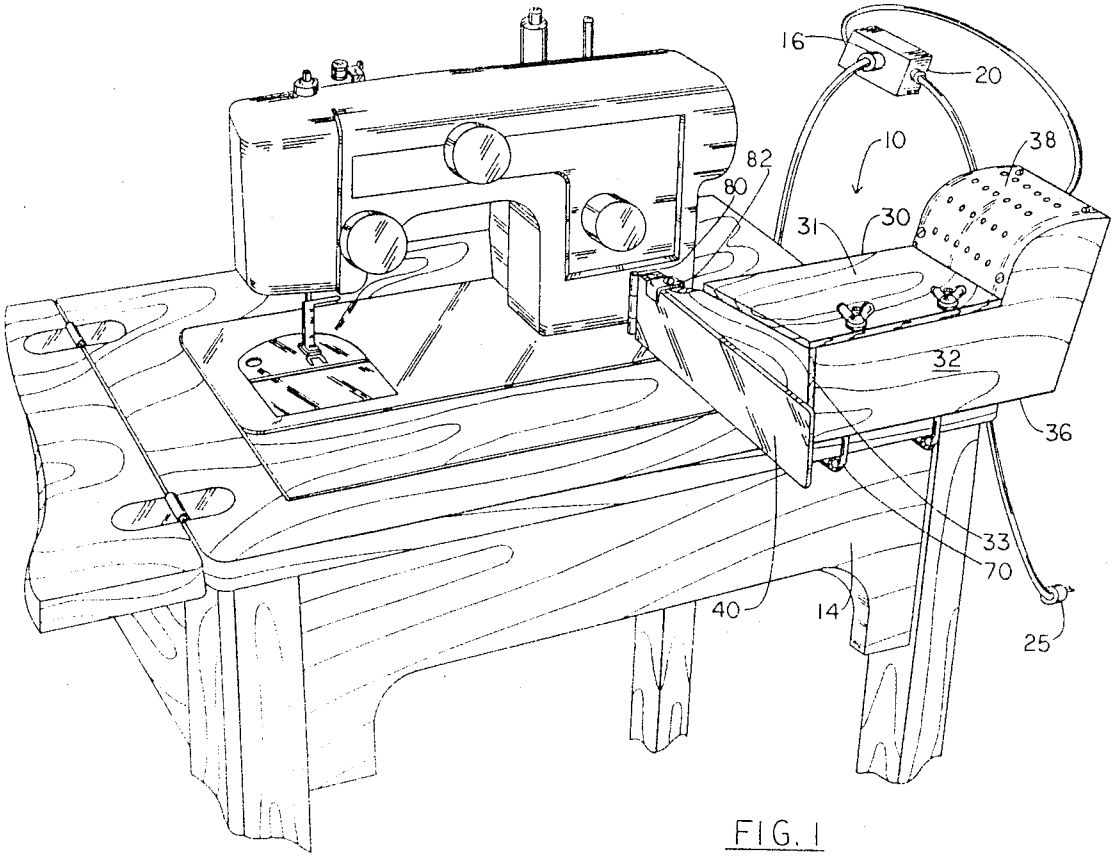
Figure 2:
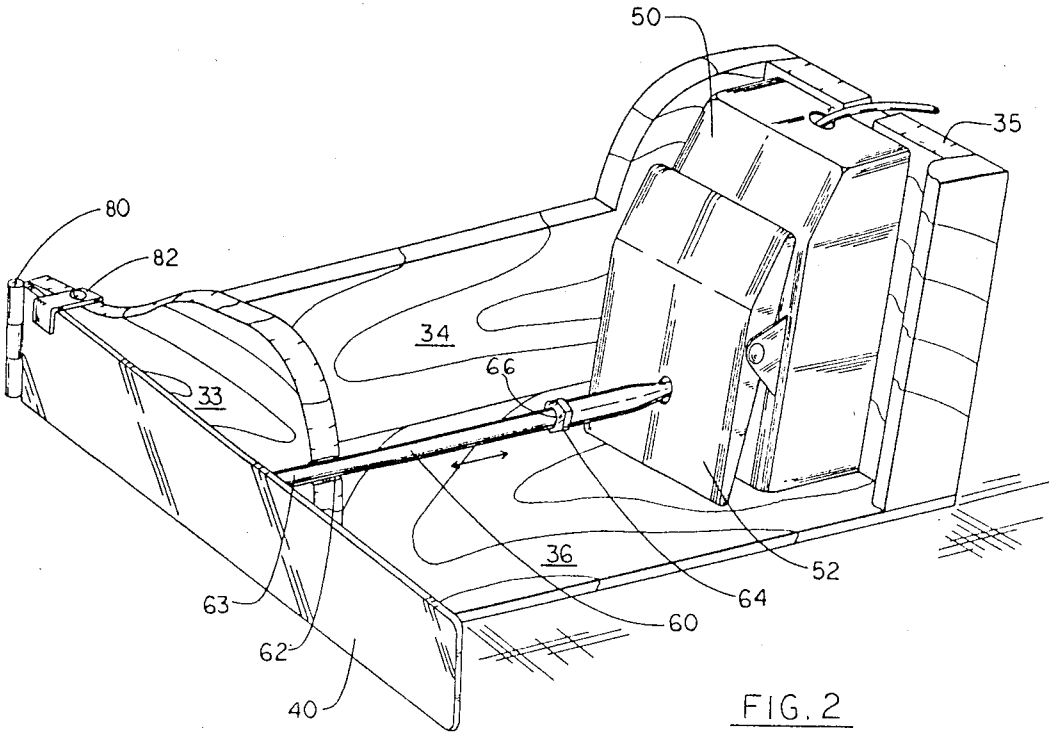

Looking first at FIG. 1, the auxillary motor control apparatus 10 is illustrated as installed on a conventional cabinet-style electric sewing machine 12. Such machines are generally operated by a standard knee or foot control which is not illustrated here. The standard control is not modified or removed when the machine is operated by the auxillary control 10. When the auxillary control 10 is attached to the machine cabinet 14, the machine electrical plug 16 is plugged into a socket 20 on the auxillary control, rather than plugging directly into the electric power supply. The control apparatus 10 has an electric plug 25 which is plugged into the main power source (not shown).

The apparatus 10 is generally comprised of a housing 30 having top wall 31 side walls 32 through 35 and bottom wall 36; an activating or control plate 40; a variable resistor 50; and a sliding plunger 60 extending between the plate 40 and resistor 50. A portion of top wall 31 includes a perforated air vent 38 for dissipation of heat from the underlying resistor 50.

The housing 30 is removably attached to the machine cabinet 14 on the upper surface thereof by means of a plurality of clamps 70. The clamps 70 can be a variety of types including C-clamps or bracket-type clamps mounted on the undersurface of housing 30. Other attachment means become apparent according to the particular surface of cabinet 14 being used.

The variable resistor 50 is mounted to the inside surface of side wall 35, by screws, adhesive, or other means such that the variable contact 52 is positioned directly opposite the side wall 33 to which the activating plate 40 is attached. A sliding plunger rod 60 extends through an aperture 62 in side wall 33, and is connected to resistor 50 by means of an adjustable threaded connector 64. The adjustable connector 64 is internally threaded to receive the externally threaded end 66 of the plunger.

When necessary to adjust the rod length from plate 40 to resistor 50, the plunger rod 60 is threaded inwardly or outwardly of connector 64. The plunger 60 is freely slidably positioned in aperture 62 such that the end 63 lies outside the housing for selective contact by plate 40.

The activating or control plate 40 is an elongated flat, preferably stainless steel plate having one end connected to the housing by means of a hinge 80. The hinge 80 includes a stop bracket 82 to limit the plate 40 from swinging outwardly away from the housing. When the plate 40 is depressed, the plunger 60 is contacted and pushed inwardly to contact the resistor 50.

The variable contact plate 52 is spring biased in an operative position and is engaged by plunger 60 to activate the resistor. Increasing pressure on plate 50 increases the speed of the machine. Thus the resistor 50 operates substantially the same as the motor controls provided with conventional electric sewing machines. When pressure on the control plate 40 is relieved, the plunger retracts from contact with resistor 50 and the machine is stopped.

While other and further modifications may be made to the above described apparatus the invention is limited only by the scope of the claims below.

What I claim is:

1. A portable auxillary control apparatus for selectively adapting a conventional cabinet-type, electric-motor-powered sewing machine for use by handicapped persons wherein said sewing machine includes a standard knee or foot-operated or other type of standard control; said control apparatus comprising:

(a) a housing having means for being removably mounted on a selected surface area of said cabinet;

(b) a variable means mounted in said housing for controlling the start-up, speed, and stopping of said electric motor;

(c) a control arm hingedly mounted on the exterior of said housing and to which pressure is applied for activating said variable means;

(d) plunger means passing through said housing and operatively connecting said control arm and said variable means for transmitting pressure from said control arm to said variable means:

(e) electrical outlet means for receiving the electrical plug from said knee or foot operated control, thereby selectively connecting said auxillary control to said sewing machine motor such as to bypass said standard knee or foot operated control;

whereby application of pressure to said control arm is transmitted to said variable motor-control means and thus to said machine motor.

2. A control apparatus according to claim 1 wherein said variable means comprises a variable resistor.

3. A control apparatus according to claim 1 wherein said plunger further includes means for adjusting the operative distance between said control arm and said variable means.

* * * * *